US011577282B2

(12) United States Patent
Ruttkay et al.

(10) Patent No.: US 11,577,282 B2
(45) Date of Patent: Feb. 14, 2023

(54) PRESSURIZED CLEANING APPARATUS COMPRISING A PRESSURE GENERATION UNIT

(71) Applicant: Robert Bosch GmbH, Stuttgart (DE)

(72) Inventors: Tibor Levente Ruttkay, Miskolc (HU); Alex Harrison, Bury St Edmunds (GB); Miklos Zoldi, Wortham (GB)

(73) Assignee: Robert Bosch GmbH, Stuttgart (DE)

( * ) Notice: Subject to any disclaimer, the term of this patent is extended or adjusted under 35 U.S.C. 154(b) by 633 days.

(21) Appl. No.: 16/603,734

(22) PCT Filed: Apr. 12, 2018

(86) PCT No.: PCT/EP2018/059435
§ 371 (c)(1),
(2) Date: Oct. 8, 2019

(87) PCT Pub. No.: WO2018/192838
PCT Pub. Date: Oct. 25, 2018

(65) Prior Publication Data

US 2021/0107038 A1 Apr. 15, 2021

(30) Foreign Application Priority Data

Apr. 18, 2017 (DE) ..... 10 2017 206 504.4

(51) Int. Cl.
*B08B 3/02* (2006.01)
*F04B 49/08* (2006.01)
(Continued)

(52) U.S. Cl.
CPC ..... *B08B 3/028* (2013.01); *F04B 17/03* (2013.01); *F04B 17/06* (2013.01); *F04B 49/02* (2013.01);
(Continued)

(58) Field of Classification Search
CPC ..... B08B 3/028; F04B 17/03; F04B 17/06; F04B 49/065; F04B 49/08; F04B 49/20;
(Continued)

(56) References Cited

U.S. PATENT DOCUMENTS

2018/0193854 A1* 7/2018 Haney ..... B08B 5/02
2019/0388918 A1* 12/2019 Gustafson ..... B05B 9/0861
2022/0055080 A1* 2/2022 Galyuk ..... B08B 13/00

FOREIGN PATENT DOCUMENTS

CN 101573508 A 11/2009
DE 101 46 289 A1 11/2002
(Continued)

OTHER PUBLICATIONS

International Search Report corresponding to PCT Application No. PCT/EP2018/059435, dated Jul. 10, 2018 (German and English language document) (5 pages).

*Primary Examiner* — Charles G Freay
(74) *Attorney, Agent, or Firm* — Maginot, Moore & Beck LLP

(57) ABSTRACT

In a pressurized cleaning apparatus comprising a pressure generation unit for pressurizing a fluid, in particular for supplying a pressurized fluid via a hose attachment, preferably via a hand-held pistol or a spray nozzle, an operating unit is provided that is designed to make it possible to set a maximum operating pressure of the pressure generation unit at which the pressure generation unit is deactivated.

21 Claims, 8 Drawing Sheets

(51) Int. Cl.

| | |
|---|---|
| ***F04B 17/03*** | (2006.01) |
| ***F04B 17/06*** | (2006.01) |
| ***F04B 49/06*** | (2006.01) |
| ***F04B 49/20*** | (2006.01) |
| ***F04B 49/02*** | (2006.01) |

(52) U.S. Cl.
CPC ..... *F04B 49/065* (2013.01); *F04B 49/08* (2013.01); *F04B 49/20* (2013.01); *F04B 2205/04* (2013.01); *F04B 2205/05* (2013.01); *F04B 2205/09* (2013.01)

(58) Field of Classification Search
CPC ..... F04B 2205/04; F04B 2205/05; F04B 2205/09
See application file for complete search history.

(56) References Cited

FOREIGN PATENT DOCUMENTS

| | | | | |
|---|---|---|---|---|
| DE | 10 2005 028 116 | A1 | | 12/2006 |
| DE | 10 2014 106 468 | A1 | | 11/2015 |
| EP | 3907010 | A1 | * | 10/2021 |
| WO | 2013/123969 | A1 | | 8/2013 |
| WO | 2016/066209 | A1 | | 5/2016 |
| WO | 2016/184529 | A1 | | 11/2016 |

* cited by examiner

700

| 710 | $P_{max}$ | $P_{min}$ | P |
|---|---|---|---|
| 1 | 7 bar | 1 bar | 4 bar |
| 2 | 11 bar | 5 bar | 8 bar |
| 3 | 15 bar | 9 bar | 12 bar |

Fig. 8

800

| | 710 | P | $\dot{V}$ |
|---|---|---|---|
| 162 | 1 | 4 bar | 1.5 l/min |
| | 2 | 8 bar | 2.3 l/min |
| | 3 | 12 bar | 2.7 l/min |
| 168 | 1 | 4 bar | 1.5 l/min |
| | 2 | 8 bar | 2.3 l/min |
| | 3 | 12 bar | 2.7 l/min |
| 164 | 1 | 3 bar | 2 l/min |
| | 2 | 6.5 bar | 2.7 l/min |
| | 3 | 9.5 bar | 3.5 l/min |
| 166 | 1 | 1 bar | 2.5 l/min |
| | 2 | 2 bar | 3.5 l/min |
| | 3 | 3 bar | 4.5 l/min |

PRESSURIZED CLEANING APPARATUS COMPRISING A PRESSURE GENERATION UNIT

This application is a 35 U.S.C. § 371 National Stage Application of PCT/EP2018/059435, filed on Apr. 12, 2018, which claims the benefit of priority to Serial No. DE 10 2017 206 504.4, filed on Apr. 18, 2017 in Germany, the disclosures of which are incorporated herein by reference in their entirety.

BACKGROUND

The present disclosure relates to a pressure cleaning device having a pressure generating unit for pressurizing a fluid, in particular for delivering a pressurized fluid via a hose attachment, preferably via a hand gun or via a cleaning nozzle.

Such a pressure cleaning device having a pressure generating unit for pressurizing a fluid is known from the prior art. In that case, the pressurized fluid is in particular provided for delivery via a hose attachment. In that case, the hose attachment is in the form of a hand gun or cleaning nozzle. In that case, a maximum operating pressure of the pressure cleaning device, at which the pressure generating unit is deactivated, is preset and cannot be adapted and/or set in an application-specific manner.

SUMMARY

The present disclosure provides a novel pressure cleaning device having a pressure generating unit for pressurizing a fluid, in particular for delivering a pressurized fluid via a hose attachment, preferably via a hand gun or via a cleaning nozzle. An operating unit is provided, which is configured to allow setting of a maximum operating pressure of the pressure generating unit, at which the pressure generating unit is deactivated.

The disclosure therefore allows the provision of a pressure cleaning device, in which efficient and safe operation can be allowed by the setting of the maximum operating pressure. In particular, in this case, application-specific setting, or setting of a maximum operating pressure adapted to a settable operating pressure, can be allowed and thus an energy-saving pressure cleaning device can be provided.

The operating unit is preferably configured to allow additional setting of at least one variable drive parameter of the pressure generating unit. In this way, setting of a further drive parameter can be allowed in a simple manner.

Preferably, the operating unit is configured to set a minimum operating pressure of the pressure generating unit, at which the pressure generating unit is activated. In this way, setting of a minimum operating pressure adapted to a settable operating pressure can be allowed in a simple and uncomplicated manner, and so an energy-efficient pressure cleaning device can be provided.

According to one embodiment, a control device is provided, which is configured to control, preferably to switch on and/or off, the pressure generating unit on the basis of a respectively set maximum and/or minimum operating pressure, in particular depending on a set drive parameter. In this way, control of the pressure cleaning device can be allowed in a simple manner.

The control device preferably prevents the pressure from exceeding the respective maximum operating pressure by deactivating the pressure generating unit and/or activates at least the pressure generating unit if the pressure drops below the respective minimum operating pressure or a cut-in pressure. In this way, safe and reliable operation of the pressure cleaning device can be allowed.

The pressure generating unit preferably has an electric motor, wherein the at least one variable drive parameter is a speed of the electric motor. In this way, suitable regulation of the pressure cleaning device can be allowed in an easy and uncomplicated manner.

According to one embodiment, the pressure generating unit is assigned a control device, which is configured to control the speed of the electric motor. In this way, control and/or setting of a desired speed of the electric motor can be allowed.

Preferably, the pressure generating unit has a pump, and a measuring unit for determining a respectively current operating pressure of the pressure generating unit is arranged at a pump outlet of the pump. In this way, determination of the current operating pressure can be allowed in a simple and uncomplicated manner.

Preferably, the measuring unit is configured in the manner of a preferably electric pressure sensor and/or of a flow rate sensor. In this way, a robust and stable measuring unit can be provided.

Preferably, a rechargeable battery pack is provided at least for the power supply of the pressure generating unit. In this way, a power supply of the pressure generating unit in the case of mobile use of the pressure cleaning device can be allowed in a simple and uncomplicated manner.

According to one embodiment, the pressure cleaning device is configured in the manner of a low-pressure cleaning device, wherein the pressure generating unit is configured to generate a maximum operating pressure of less than 25 bar, preferably less than 20 bar, and particularly preferably less than 15 bar, and wherein the low-pressure cleaning device is operable without a nozzle distancing element, in particular without a lance. In this way, a pressure cleaning device that can be used for an application for cleaning light to moderate soiling can be provided in a simple manner.

Preferably, a maximum and/or minimum operating pressure is settable depending on a current operating pressure, wherein the maximum and/or minimum operating pressure is higher or lower than the currently determined operating pressure by a predefined percentage or predefined absolute pressure. In this way, automatic operation of the pressure cleaning device depending on a respectively currently determined maximum and/or minimum operating pressure can be allowed in a simple manner.

Furthermore, the present disclosure provides a pressure cleaning device having a hand gun, in particular a pressure cleaning device as already described above, wherein the hand gun, for delivering the fluid pressurized by the pressure generating unit, preferably has at least two different nozzles for selectively delivering at least two different fluid jet types. In this way, an application-specific fluid jet type can be set in a simple and uncomplicated manner during operation of the pressure cleaning device.

The control device of this pressure cleaning device is preferably configured to identify a used hose attachment or a used fluid jet type on the basis of a pressure curve sensed by the preferably electric pressure sensor and/or of an operating pressure curve and/or a current flow rate or flow rate curve. In this way, easy and uncomplicated operation of the pressure cleaning device can be allowed, wherein automatic identification of a used hose attachment is allowed.

Preferably, automatic determination of a maximum and/or minimum operating pressure is settable via the determined pressure curve and/or flow rate curve. In this way, setting of the maximum and/or minimum operating pressure can be allowed in a simple manner.

BRIEF DESCRIPTION OF THE DRAWINGS

The disclosure is explained in more detail in the following description on the basis of exemplary embodiments illustrated in the drawings, in which:

FIG. 8 shows an example of an operating mode/operating pressure table depending on different fluid jet types.

DETAILED DESCRIPTION

Figure 1:
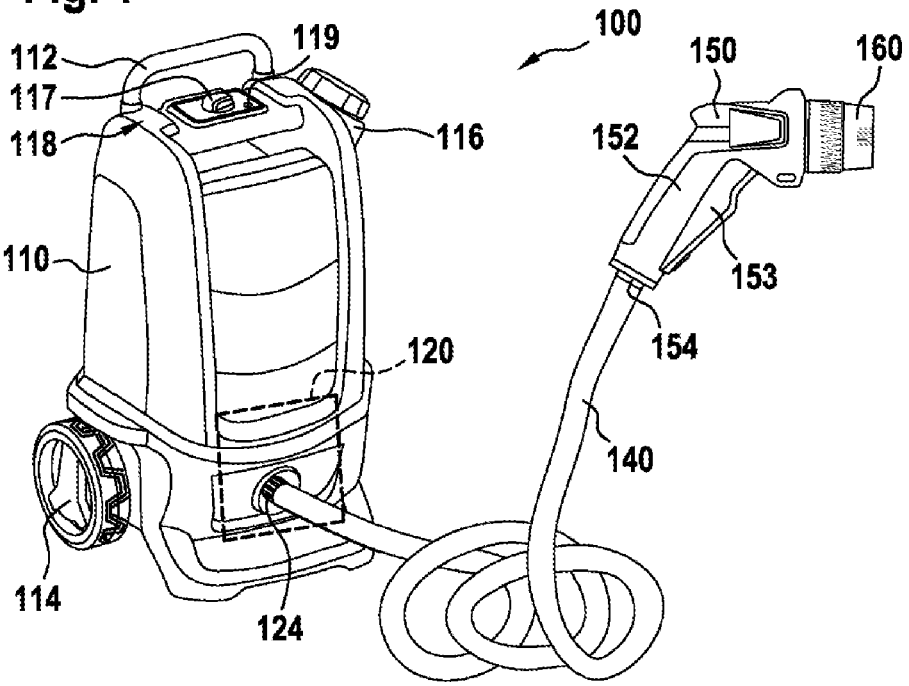
FIG. 1 shows a perspective view of a pressure cleaning device having a hose attachment according to one embodiment.

FIG. 1 shows a cleaning device 100, configured for example as a pressure cleaning device, having a housing 110. Arranged in the housing 110 is preferably a pressure generating unit 120 for pressurizing a fluid.

According to one embodiment, the pressure cleaning device 100 is in the form of a low-pressure cleaning device, wherein the pressure generating unit 120 is configured to generate a maximum operating pressure of less than 25 bar, preferably less than 20 bar and particularly preferably less than 15 bar. The low-pressure cleaning device is operable preferably without a nozzle distancing element, in particular without a lance. Alternatively, or in addition thereto, the pressure cleaning device 100 can also be configured as a high-pressure cleaning device, however.

Such a preferably multifunctional pressure cleaning device 100 can be used in a wide variety of areas, in particular in light to moderate cleaning tasks, for example for cleaning articles such as vehicles, for example cars, bicycles, in particular mountain bikes, and/or for cleaning toys, in particular children's toys, and/or for cleaning items of clothing, for example boots, in particular rubber boots, and/or for cleaning implements, in particular garden implements, for example shovels, spades etc., and/or for cleaning pets, for example horses, dogs or the like. Furthermore, the pressure cleaning device 100 can also be used in the garden, for example for watering plants, and/or when camping, for example as a mobile shower. It should be noted that the described possible applications are merely by way of example and should not be considered as limiting the disclosure; thus, the pressure cleaning device 100 can also be used in any desired other applications.

Preferably, the pressure generating unit 120 has a motor (not illustrated). The motor is preferably configured as a combustion engine and/or electric motor. In the case of an electric motor, for the supply of power independently of the mains, a rechargeable battery pack can be provided, and/or, for the supply of mains power, a cable connection can be provided. Preferably, the motor is configured as an electric motor to which a rechargeable battery pack is assigned.

Furthermore, the pressure cleaning device 100 has preferably at least one, as illustrated two wheels 114 for movement on any desired underlying surface. Preferably, the wheels 114 are configured such that movement over terrain, for example in the garden etc., is possible. In this case, as a result of the preferably stable configuration, the wheels 114 allow stable positioning and thus safe operation. In order to safely grip the pressure cleaning device 100, the housing 110 is assigned preferably at least one handle 112. Preferably, the handle 112 is telescopic. Alternatively or optionally, the pressure cleaning device 100 has at least one carrying handle, which is configured for carrying the pressure cleaning device 100 in the manner of a bag and/or backpack.

Furthermore, the pressure cleaning device 100 has preferably at least one fluid tank 116. According to one embodiment, the fluid tank 116 is fixedly connected to the housing 110. However, according to a further embodiment, the fluid tank 116 can be configured to be removable from the housing 110, such that said fluid tank 116 is removable from the housing 110 for filling and/or cleaning. The fluid tank 116 has preferably a capacity of 15 l. However, a configuration of the fluid tank 116 with a capacity of 15 l should not be considered as limiting the disclosure. Thus, the capacity of the fluid tank 116 can also be less than or greater than 15 l.

Alternatively or optionally, the pressure cleaning device 100 can also be fed with an appropriate fluid via an external fluid source, for example a lake, stream, faucet etc. For this purpose, preferably a connection element, for example a connection adapter, is arranged on the housing 110, via which connection adapter the pressure cleaning device 100 is connectable to the external fluid source for taking up fluid. Furthermore, alternatively or optionally, a further fluid tank and/or a further connection element for a cleaning fluid, for example a detergent, can be provided.

Preferably, the pressure cleaning device 100 has an operating unit 118, which has at least one on/off operating element 119, which is configured for activating and/or deactivating the pressure cleaning device 100, or for switching it on and/or off. Furthermore, the operating unit 118 can also be configured for example for setting a selectable operating mode, an operating pressure, a motor speed and/or any desired other parameter, in particular a drive parameter. For this purpose, the operating unit 118 has preferably an input unit 117, by means of which a selectable operating mode, an operating pressure, a motor speed and/or any desired other parameter, in particular a drive parameter, is settable. This input unit 117 is configured preferably in the manner of a setting dial, keypad and/or touch element. Alternatively or optionally, the operating unit 118 can also be assigned a display device, which is integrated into the housing 110. Furthermore, the operating unit 118 can alternatively or optionally also be configured externally, wherein for example the pressure cleaning device 100 can be operated via a smartphone, tablet or the like.

Furthermore, for the variable delivery of the pressurized fluid, the pressure cleaning device 100 can be connectable to a hose attachment 150 preferably via a hose 140. The hose 140 is in this case adapted to a maximum possible operating pressure of the pressure cleaning device 100. In this case, the hose 140 can preferably be configured in the manner of a high-pressure hose for a high-pressure cleaning device and/or preferably in the manner of a low-pressure hose, for example of a garden hose, for a low-pressure cleaning device. In this case, the hose 140 can be wound up manually on the housing 110 or be able to be wound up preferably via an automatic winding device. Furthermore, the hose 140 can also be configured in the manner of a spiral hose. In this case, an end of the hose 140 by the pressure cleaning device 100 can be fixedly connected to the pressure cleaning device 100 or be arranged in a detachable manner on the pressure cleaning device 100. As illustrated, the hose 140 is arranged in a detachable manner at a coupling element 124 of the pressure cleaning device 100. Furthermore, analogously thereto, the hose attachment 150 can be connected fixedly to the hose 140 or preferably be connected thereto in a detachable manner via a coupling part 154.

According to one embodiment, the hose attachment 150 has a housing 152, a device 160 for setting at least two different fluid jet types and/or an operating element 153 for activating a fluid delivery. Preferably, the hose attachment 150 is configured in the manner of a hand gun, wherein the housing 152 is configured in a gun-shaped manner. However, it should be noted that the configuration of the hose attachment 150 in the manner of a hand gun is merely by way of example and should not be considered as limiting the disclosure. Thus, the hose attachment 150 can also have a tubular housing 152 and/or be configured as a cleaning nozzle. It should be noted that such a cleaning nozzle is used preferably directly on a hose 140 configured preferably as a garden hose. In this case, in an application with a cleaning nozzle, a pressure generating unit 100 for pressurizing the fluid is not absolutely necessary.

The device 160 is configured preferably for delivering the fluid pressurized preferably by the pressure generating unit 120. In this case, the device 160 is configured to set at least two different fluid jet types, wherein the device 160 has preferably a nozzle head and/or nozzle selection head, or is configured in a corresponding manner. In this case, the device 160 has at least one nozzle, preferably and in particular at least two different nozzles (162, 164, 168 in FIG. 2), for selectively delivering at least two different fluid jet types. Preferably, the device 160 is provided in particular with at least two different nozzles (162, 164, 168 in FIG. 2), wherein each of the at least two different nozzles (162, 164, 168 in FIG. 2) is assigned one of the at least two different fluid jet types. Preferably, the different fluid jet types are configured as a fan jet, spot jet and/or cone jet. However, other fluid jet types can also be used, for example a free flow jet, i.e. a substantially irregular fluid jet, which leaves the hose attachment 150 in the manner of a shower spray or rain jet with comparatively little pressure, and/or a combined fluid jet type, which can preferably be made up of at least two fluid jet types, i.e. for example a spray jet radially on the outside and a spot jet radially on the inside.

A selected fluid jet type is set preferably by rotation, in particular twisting of the device 160 or of the nozzle head. Preferably, in this case, a nozzle assigned to the selected fluid jet type is arranged at a fluid outlet opening (170 in FIG. 2), with the result that fluid is admitted to the selected nozzle. Furthermore, it is also possible for a nozzle to be configured for the formation of at least two different fluid jet types, wherein the nozzle is configured for example as a baffle plate and setting of the at least two different fluid jet types are settable by setting a distance of the baffle plate from a fluid outlet. Such a nozzle is used preferably in an above-described cleaning nozzle.

Figure 2:
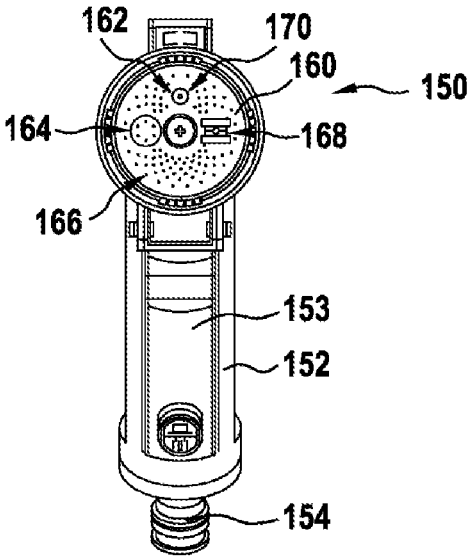
FIG. 2 shows a front view of the hose attachment in FIG. 1.

FIG. 2 shows the hose attachment 150, configured preferably as a hand gun, in FIG. 1, which, for the sake of simplicity of the description, is referred to as hand gun 150 in the following text. In this case, FIG. 2 illustrates the device 160, configured preferably as a nozzle head, for setting different fluid jet types. Furthermore, FIG. 2 illustrates a fluid outlet 170 of the hand gun 150, which is arranged preferably in a 12 o'clock position of the nozzle head 160. It should be noted, however, that the fluid outlet 170 can also be arranged in any desired other position of the nozzle head 160.

Furthermore, FIG. 2 illustrates the nozzle head 160 with the preferably at least two, as illustrated four nozzles 162, 164, 166, 168. In this case, the nozzle 162 is configured preferably to form a cone jet, the nozzle 164 is configured to form a spray jet, the nozzle 166 is configured to form a free flow jet, i.e. for example a shower spray, and the nozzle 168 is configured to form a fan jet. It should be noted, however, that nozzles for forming further fluid jet types can also be used. Furthermore, it is noted that the configuration of the nozzle head 160 with the, as illustrated, four nozzles 162, 164, 166, 168 is merely by way of example and should not be considered as limiting the disclosure. Thus, the nozzle head 160 can also have fewer or more than the four nozzles 162, 164, 166, 168. Furthermore, the arrangement of the preferably four nozzles 162, 164, 166, 168 is likewise by way of example and should not be considered as limiting the disclosure. Thus, the nozzles 162, 164, 166, 168 can also be arranged in any desired other orders or arrangements in the circumferential direction of the nozzle head 160.

Preferably, a desired fluid jet type is set, as described above, by rotation, in particular twisting of the nozzle head 160 relative to the hand gun 150. It should be noted, however, that setting can also take place by any desired other movement, for example by a linear and/or radial movement of a correspondingly selected nozzle of the nozzles 162, 164, 166, 168 in front of the fluid outlet 170.

Figure 3:
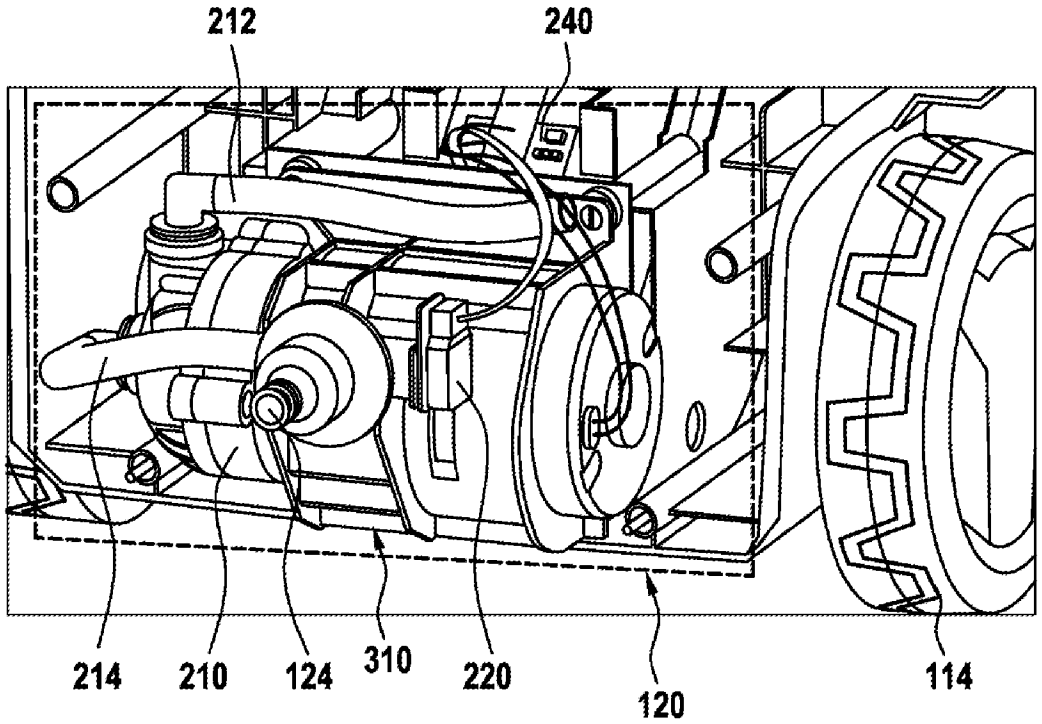
FIG. 3 shows a perspective view of a pressure generating unit assigned to the pressure cleaning device in FIG. 1.

FIG. 3 shows the pressure cleaning device 100 in figure and in this case illustrates the pressure generating unit 120, which has preferably a motor 310 and a pump 210 and also a control device 240. Preferably, the motor 310 is configured as an electric motor, wherein preferably the pressure generating unit 120 is supplied with power in a cordless manner via a rechargeable battery pack 320. However, as described above, the pressure generating unit 120 can also have a mains power supply.

The pump 210 has preferably a pump inlet 212, via which the fluid is transported to the pump 210, and a pump outlet 214, via which the pressurized fluid leaves the pump 210. In this case, the pump outlet 214 is connected to the coupling element 124. Furthermore, at least and preferably one measurement unit 220 at least for determining a respectively current operating pressure of the pressure generating unit 120 is arranged preferably at the pump outlet 214. As illustrated, the measurement unit 220 is arranged at the pump outlet 214, but can also be arranged in the hose 140 and/or in the hand gun 150. In this case, in the case of an arrangement of the measurement unit 220 in the hand gun 150, there can be a wired connection and/or a radio connection for communication with the control device 240.

Preferably, the at least one measurement unit 220 is configured in the manner of a pressure sensor, particularly preferably in the manner of an electric pressure sensor, and/or in the manner of a flow rate sensor. In this case, the electric pressure sensor is provided to determine a respectively current operating pressure and/or the flow rate sensor is provided to determine a respectively current flow rate or a respectively current volumetric flow rate. In this case, the control device 240 is configured to control the pressure generating unit 120 in particular on the basis of a respectively set operating mode depending on a respectively current determined operating pressure and/or a respectively current determined flow rate or the currently determined volumetric flow rate. In this case, the measurement unit 220 is configured to electrically measure the operating pressure and/or the flow rate. Pressure measurement by means of a spring-loaded pressure regulating valve is ruled out according to the disclosure. Furthermore, it should be noted that, according to the disclosure, the pressure cleaning device 100 is configured without a bypass.

According to one embodiment, the pressure generating unit 120 is operable in at least two different operating modes. In this case, operating mode setting takes place preferably via the operating unit 118, in particular via the input unit 117 of the pressure cleaning device 100 in FIG. 1. Preferably, the operating unit 118 is configured to allow setting of at least two different operating modes. The operating modes can in this case be configured as preset modes, to which for example different operating pressures are assigned, for example a soft mode with a low operating pressure, a medium mode with a medium operating pressure and/or a turbo mode with a high operating pressure. Furthermore, the operating unit 118 can alternatively or optionally be configured to set a desired operating pressure. In this case, operating pressure setting can be considered to be an operating mode. Furthermore, an alternative or optional operating mode can be provided, which can be configured preferably as an automatic mode, wherein operating pressure setting can take place automatically preferably depending on a respectively used and detectable hose attachment 150.

Preferably, the operating unit 118 is configured to allow setting of a maximum operating pressure (Pmax in FIG. 6) of the pressure generating unit 120, at which the pressure generating unit 120 is deactivated, and/or a minimum operating pressure (Pmin in FIG. 6) of the pressure generating unit 120, at which the pressure generating unit (120) is activated, and/or additional setting of at least one variable drive parameter of the pressure generating unit 120. Preferably, the control device 240 is configured to control the pressure generating unit 120, preferably to switch it on and/or off, on the basis of a respectively set maximum and/or minimum operating pressure (Pmax, Pmin in FIG. 6), in particular depending on a respectively set drive parameter. In this case, preferably the at least one variable drive parameter is a speed of the electric motor 310. In this case, the control device 240 is preferably configured to control the speed of the motor 310.

According to one embodiment, each of the at least two different operating modes is assigned in each case a separate maximum operating pressure (Pmax in FIG. 6) and/or the respective operating mode is assigned a predefined speed of the motor 310. In this case, the control device 240 is preferably configured to control the motor 310. Furthermore, alternatively or optionally, the control device 240 is configured to prevent the pressure from exceeding the respective separate maximum operating pressure (Pmax in FIG. 6). Furthermore, preferably each of the at least two different operating modes is assigned in each case a separate minimum operating pressure (Pmin in FIG. 6) and/or a cut-in pressure (Pein in FIG. 10). Preferably the control device 240 is in this case configured to prevent the pressure from dropping below the respective separate minimum operating pressure (Pmin in FIG. 6) or, if the pressure drops below the cut-in pressure (Pein in FIG. 10), to activate at least the motor 310. Preferably, the control device 240 prevents the pressure from exceeding the respective separate maximum operating pressure (Pmax in FIG. 6) by deactivating the pressure generating unit 120 and/or, if the pressure drops below the respective separate minimum operating pressure (Pmin in FIG. 6) or the cut-in pressure (Pein in FIG. 10), activates at least the pressure generating unit 120.

Alternatively or optionally, the control device 240 is configured to set a maximum and/or minimum operating pressure (Pmax, Pmin in FIG. 11) depending on a respectively current operating pressure and/or an operating pressure curve and/or a current flow rate or flow rate curve. According to one embodiment, the maximum and/or minimum operating pressure (Pmax, Pmin) is higher or lower than the currently determined operating pressure by a predefined percentage or predefined absolute pressure. Preferably, the maximum and/or minimum operating pressure (Pmax, Pmin) is 3 bar higher or lower than the currently determined operating pressure. It should be noted that the maximum and/or minimum operating pressure (Pmax, Pmin) can also be more or less than 3 bar higher or lower than the currently determined operating pressure.

Alternatively or optionally, the control device 240 is configured to identify a used hose attachment 150 or a used fluid jet type depending on a respectively current operating pressure and/or an operating pressure curve and/or a current flow rate or flow rate curve. In this case, the control device 240 is preferably configured to store and/or output at least one item of information about the currently used hose attachment 150 or the used fluid jet type. Output can in this case take place for example at a mobile terminal, for example a smartphone and/or a tablet, or at some other human-machine interface. In this case, such an output can output the corresponding information preferably in a tactile and/or acoustic manner. Furthermore, the information can also be stored and/or output for "condition monitoring".

Furthermore, the at least two different fluid jet types are assigned in each case separate maximum operating pressures that depend on a respectively set operating mode. In this case, the control device 240 is preferably configured to identify a current fluid jet type or nozzle position of the hand gun 150 on the basis of the pressure curve (510 in FIG. 6) sensed by the preferably electric pressure sensor 220. Preferably, in this case automatic determination of a maximum and/or minimum cut-in operating pressure (Pmax, Pmin, Pein in FIG. 6) is settable via the determined pressure curve (510 in FIG. 6).

Furthermore, the control device 240 is alternatively or optionally configured to infer a condition of the pressure cleaning device 100 and/or to monitor the condition of the pressure cleaning device 100 depending on a current operating pressure and/or an operating pressure curve and/or a current flow rate or flow rate curve, or a volumetric flow profile. In this case, condition monitoring can include for example identification of a degree of calcification of the nozzle. This can be identified preferably from a rapid drop in pressure during a closing operation of the nozzle or the fluid outlet. Alternatively or optionally, condition monitoring can also include for example identification of a leak, for example on account of an excess pressure or too low a volumetric flow rate. When a degree of calcification and/or a leak is identified, a warning can be output. Furthermore, such error messages can be collated in a protocol and/or an indication for maintenance, a cleaning operation and/or replacement, for example of a hose or the like, can be output.

Alternatively or optionally, the control device 240 is configured to deactivate the pressure generating unit 120 if a predefined dry running operating pressure, which signals in particular an empty storage tank 116 and/or a kink in the hose 140 and/or a fluid supply hose, occurs.

Furthermore, the control device 240 is alternatively or optionally configured to switch off the pressure cleaning device 100 after a predefined period without actuation of the hose attachment 150 and/or without the pressure dropping below the cut-in pressure (Pein in FIG. 10). Preferably, a switch off occurs after a duration of 10 minutes. It should be noted, however, that the duration of 10 minutes is merely by way of example and should not be considered as limiting the disclosure. Thus, a switch off can also take place after a duration of less than 10 minutes or more than 10 minutes. Furthermore, it may also be possible to set the duration via the operating unit 118.

Figure 4:
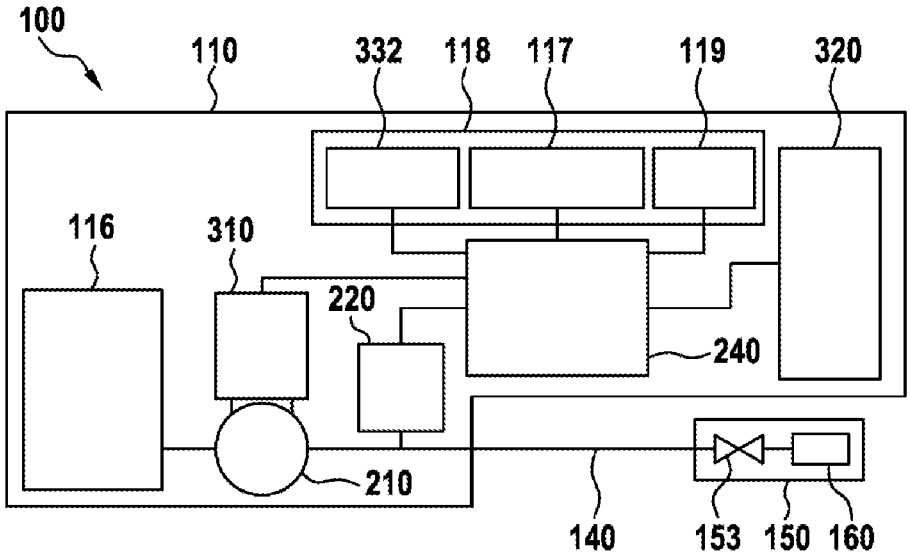
FIG. 4 shows a schematic illustration of the pressure cleaning device in FIG. 1 and FIG. 3.

FIG. 4 shows the pressure cleaning device 100 in figure and FIG. 3 and illustrates a preferred structure. FIG. 4 also illustrates the control device 240, which is connected preferably to the measurement unit arranged at the pump output 214 and configured as an electric pressure sensor 220 and is connected to the motor 310 configured preferably as an electric motor. Furthermore, the control device 240 is connected to the power supply configured preferably as a rechargeable battery pack 320. In this case, the rechargeable battery pack 320 is provided at least for the power supply of the pressure generating unit 120, of the electric pressure sensor 220, and of the control device 240. In this case, the rechargeable battery pack 320 is configured preferably to provide an operating voltage of 18 V and is configured preferably as a lithium ion rechargeable battery pack, wherein preferably at least 70 minutes of operation in the soft mode, 30 minutes of operation in the medium mode and/or 15 minutes of operation in the turbo mode are allowed. A charging operation of the rechargeable battery pack 320 can in this case take place preferably in 100 minutes.

Furthermore, the control device 240 is connected preferably to the operating unit 118, wherein the operating unit 118 is assigned at least the input unit 117 for setting an operating mode, a speed, an operating pressure etc., and the on/off operating element 119. Preferably, the operating unit 118 is also assigned a display unit 332, which can display for example a respectively set operating mode and/or a rechargeable battery pack condition.

Figure 5:
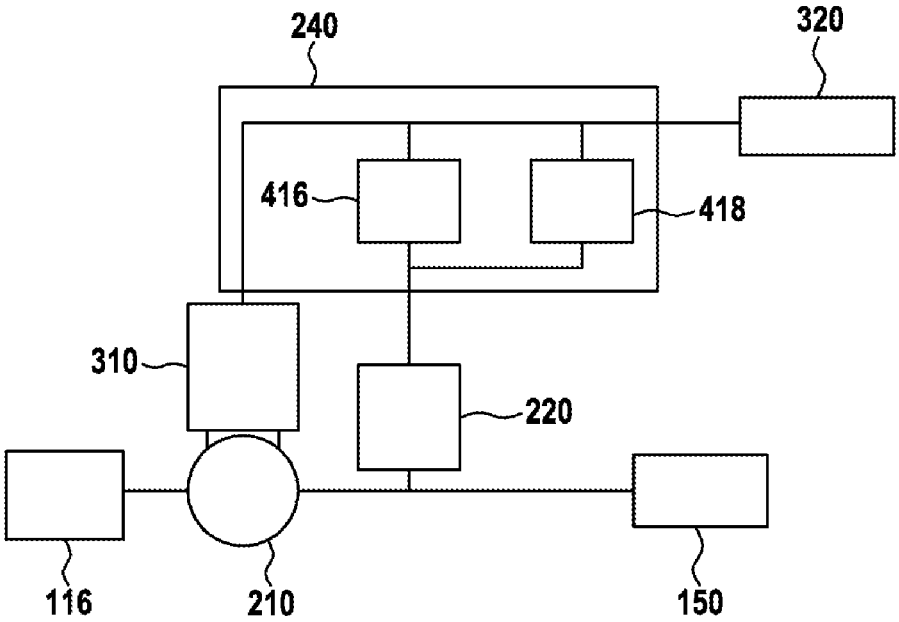
FIG. 5 shows a schematic illustration of the pressure cleaning device in FIG. 1 and FIG. 3 according to a further embodiment.

FIG. 5 shows the pressure cleaning device 100 in figure and FIG. 3 and FIG. 4, respectively, with an additional safety circuit 418, which is preferably configured, if a fault occurs or an erroneous signal is detected by a microcontroller 416 assigned to the control device 240, to control the pump 210 or the motor 310 such that damage to or destruction of the pressure cleaning device 100 or any risk to a corresponding user can be at least substantially ruled out. As illustrated, the safety circuit 418 is arranged parallel to the microcontroller 416 of the control device 240. As a result, safe operation of the pressure cleaning device 100 can be allowed, such that it is possible in particular to safely and reliably prevent the pressure from exceeding the maximum operating pressure. Preferably, the control device 240 is arranged with its microcontroller 416 on a circuit board.

Figures 6, 7:
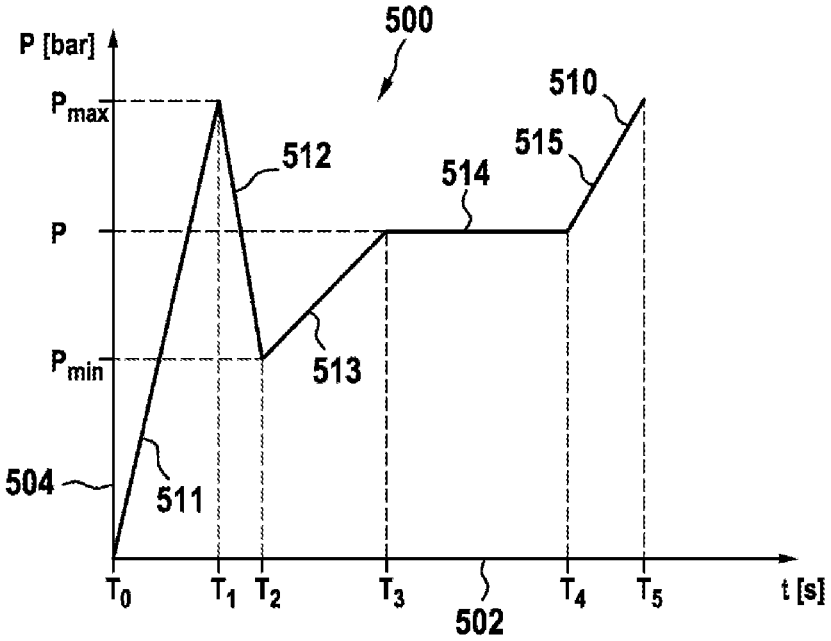
FIG. 6 shows a simplified diagram of an example of an operating pressure profile.
FIG. 7 shows an example of an operating mode/operating pressure table.

FIG. 6 shows a general and simplified diagram 500 of an example of an operating pressure profile 510 of the pressure cleaning device 100 in FIG. 1 and FIG. 3 to FIG. 5. In this case, by way of example, a time t in seconds is plotted on an X-axis 502 and an operating pressure P is plotted in bar on a Y-axis 504. Preferably, a portion 511, formed between a time T0 and T1, of the operating pressure profile 510 indicates an initial pressure buildup, during which preferably the operating pressure is built up from 0 to, as illustrated, a maximum operating pressure Pmax. When the maximum operating pressure Pmax is reached, the pressure generating unit 120 is switched off and a respectively set nozzle 162, 164, 168 can be opened, by actuating the operating element 153 of the hand gun 150, to activate fluid delivery. In the process, the operating pressure P drops for example in the portion 512, or between the time T1 and T2, to a minimum operating pressure Pmin. When this minimum operating pressure Pmin is reached, the pressure generating unit 120 is preferably activated such that it builds up the operating pressure again to a set operating pressure P. In this case, the portion 513 formed between the time T2 and T3 indicates a corresponding pressure buildup to the set operating pressure P. Once the set operating pressure P has been reached, it is maintained, as indicated in a portion 514. At a time T4, the respectively set nozzle 162, 164, 168 is closed, or fluid delivery is ended, such that the operating pressure P rises on account of the still activated pressure generating unit 120.

As illustrated and by way of example, the respective portions 511-515 of the operating pressure profile 510 are formed in a linear manner, although this should not be seen as limiting the disclosure. Thus, the portions 511-515 can also have any desired other profile, for example an exponential rise and/or drop in the operating pressure.

According to one embodiment, an operating pressure P is settable via the operating unit 118 of the pressure cleaning device 100 in FIG. 1 and FIG. 3 to FIG. 5, wherein the operating pressure P is assigned in each case a preferably predefined maximum and/or minimum operating pressure Pmax, Pmin. Generally, provision is made to prevent the pressure from exceeding the maximum operating pressure Pmax, wherein the control device 240 is preferably configured to prevent the pressure from exceeding the respective separate maximum operating pressure Pmax. Preferably, in this case the control device 240 prevents the pressure from exceeding the respective separate maximum operating pressure Pmax by deactivating the pressure generating unit 120. If, by contrast, the pressure drops below the respective separate minimum operating pressure Pmin, the pressure generating unit 120 is preferably activated.

Preferably, the maximum and/or minimum operating pressure Pmax, Pmin is higher or lower than the settable operating pressure P by a predefined percentage or predefined absolute pressure. In this case, the absolute pressure is preferably 3 bar, i.e. the maximum operating pressure Pmax is preferably 3 bar higher than the set operating pressure P, and the minimum operating pressure Pmin is preferably 3 bar lower than the set operating pressure P. Furthermore, the predefined percentage or predefined absolute pressure can also be adapted, for example in the event of wear and/or in the event of a leak. These values should ideally be selected to save energy. However, the values should not be selected to be too close together, since otherwise a large number of readjustment intervals may arise. Similarly, the values should not be too far apart, since this would in turn increase a required energy consumption. Furthermore, the maximum and/or minimum operating pressure Pmax, Pmin can also be set manually via the input unit 117 of the operating unit 118.

Furthermore, the present disclosure describes a method for operating the pressure cleaning device 100 having the pressure generating unit 120 for pressurizing the fluid and for delivering a pressurized fluid via the hose attachment 150, preferably via a hand gun or via a cleaning nozzle. The pressure cleaning device 100 is operable preferably in at least two different operating modes. In this case, a respectively current operating pressure P is determined via the preferably electric pressure sensor 220 and/or a respectively current flow rate, or volumetric flow rate V, is determined via a flow rate sensor. The pressure cleaning device 100 is controlled by the control device 240 in particular on the basis of the respectively set operating mode (710 in FIG. 7) depending on a respectively current determined operating pressure and/or a respectively current determined flow rate.

Furthermore, it is also possible for an operating mode to be set directly, wherein the operating mode is assigned a corresponding operating pressure, which is set automatically. Furthermore, an operating pressure P can also be assigned a speed, which can be set via the input unit 117.

FIG. 7 shows an example of an operating mode/operating pressure table 700 of the pressure cleaning device 100 in FIG. 1 and FIG. 3 to FIG. 5. In this case, the illustrated left-hand column indicates a respective operating mode 710, for example the above-described operating modes with a first operating mode 1, or a soft mode, a second operating mode 2, or a medium mode, and a third operating mode 3, or a turbo mode. For example, the first operating mode 1, or the soft mode, has an operating pressure P of 4 bar and a maximum operating pressure Pmax of 7 bar and a minimum operating pressure Pmin of 1 bar. Furthermore, the second operating mode 2, or the medium mode, has for example an operating pressure P of 8 bar and a maximum operating pressure Pmax of 11 bar and a minimum operating pressure Pmin of 5 bar. Furthermore, the third operating mode 3, or the turbo mode, has for example an operating pressure P of 12 bar and a maximum operating pressure Pmax of 15 bar and a minimum operating pressure Pmin of 9 bar. It should be noted that the illustrated operating pressures are merely by way of example and should not be considered as limiting the disclosure. Thus, the respective operating pressures can also have other values.

FIG. 8 shows an example of an operating mode/operating pressure table 800 of the pressure cleaning device 100 in FIG. 1 and FIG. 3 to FIG. 5, wherein the operating pressures P and associated volumetric flow rates $\dot{V}$ are illustrated depending on a respective operating mode 710 and a respectively set fluid jet type. In this case, preferably the nozzle 162 in FIG. 2, which is configured to form a cone jet, is assigned an operating pressure P of 4 bar and a volumetric flow rate $\dot{V}$ of 1.5 l/min in the first operating mode, or the soft mode, an operating pressure P of 8 bar and a volumetric flow rate $\dot{V}$ of 2.3 l/min in the second operating mode, or the medium mode, and an operating pressure P of 12 bar and a volumetric flow rate $\dot{V}$ of 2.7 l/min in the third operating mode, or the turbo mode. Preferably, the nozzle 168 in FIG. 2, which is configured to form the fan jet, is assigned the same values as the cone jet nozzle 162. The nozzle 164 in FIG. 2, which is configured to form the spray jet, is preferably assigned an operating pressure P of 3 bar and a volumetric flow rate $\dot{V}$ of 2 l/min in the first operating mode, or the soft mode, an operating pressure P of 6.5 bar and a volumetric flow rate $\dot{V}$ of 2.7 l/min in the second operating mode, or the medium mode, and an operating pressure P of 9.5 bar and a volumetric flow rate $\dot{V}$ of 3.5 l/min in the third operating mode, or the turbo mode. The nozzle 166, which is configured to form the free flow jet, is preferably assigned an operating pressure P of 1 bar and a volumetric flow rate $\dot{V}$ of 2.5 l/min in the first operating mode, or the soft mode, an operating pressure P of 2 bar and a volumetric flow rate $\dot{V}$ of 3.5 l/min in the second operating mode, or the medium mode, and an operating pressure P of 3 bar and a volumetric flow rate $\dot{V}$ of 4.5 l/min in the third operating mode, or the turbo mode. However, it should be noted that the illustrated operating pressures P and volumetric flow rates $\dot{V}$ are merely by way of example and should not be considered as limiting the disclosure. Thus, the respective operating pressures P and volumetric flow rates $\dot{V}$ can also have other values.

Figure 9:
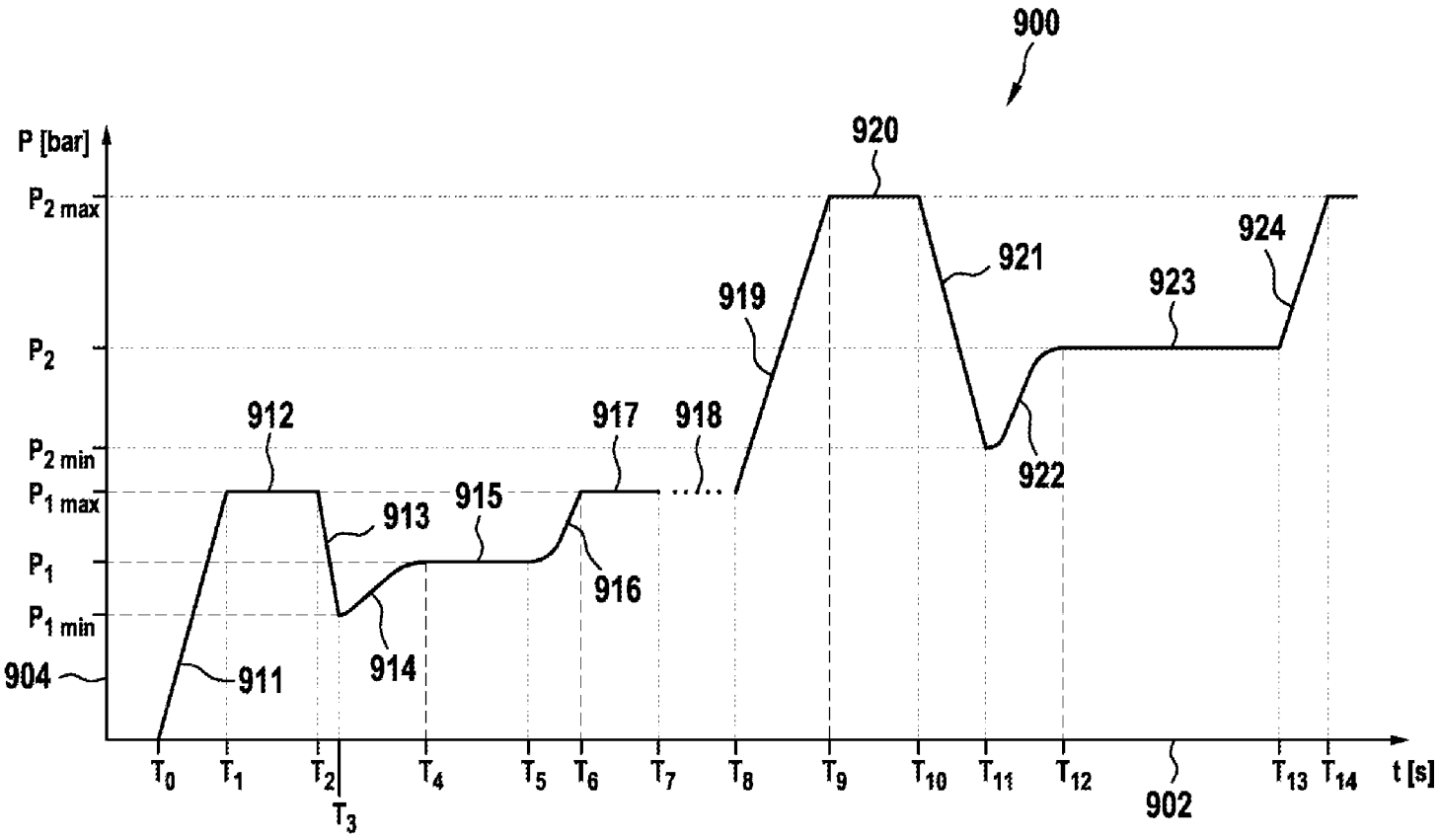
FIG. 9 shows an example of an operating pressure profile for identifying a nozzle, with a change in operating mode.

FIG. 9 shows a diagram 900 with an example of an operating pressure profile 910 of the pressure cleaning device 100 in FIG. 1 and FIG. 3 to FIG. 5. In this case, the operating pressure profile 910 indicates identification of a nozzle assigned to in each case one fluid jet type or setting of a fluid jet type, and a change of operating mode. In this case, for example a time t in seconds is plotted on an X-axis 902 and an operating pressure P is plotted in bar on a Y-axis 904.

Preferably, a portion 911, formed between a time T0 and T1, of the operating pressure profile 910 indicates an initial pressure buildup in the medium mode, or the operating mode 2, in which preferably the operating pressure is built up from 0 to, as illustrated, a maximum operating pressure P1max. When the maximum operating pressure P1max is reached, the pressure generating unit 120 is switched off. In the portion 912, the maximum operating pressure P1max is maintained until it drops, upon opening of the fluid outlet at the time T2, according to an example portion 913, to a minimum operating pressure P1min. When the minimum operating pressure P1min is reached at the time T3, the pressure generating unit 120 is activated and the operating pressure P is built up in a portion 914 until the operating pressure P1 is reached at a time T4.

Preferably, according to one embodiment, the control device 240 identifies, via a gradient assigned to the portion 914, a respectively set fluid jet type and preferably builds up an operating pressure P1 associated with the set fluid jet type. In the portion 915, operation of the set fluid jet type at its associated operating pressure P1 is illustrated.

At the time T5, the fluid outlet is closed, with the result that the operating pressure rises, in the portion 916, to the maximum operating pressure P1max and the pressure generating unit 120 is deactivated by the control device 240 at the time T6. In this case, the operating pressure, as illustrated the maximum operating pressure P1max, is preferably maintained. The portion 918 formed between the time T7 and T8 indicates an operating pause of the pressure cleaning device 100.

At the time T8, a change of operating mode into the operating mode 3, or the turbo mode, takes place for example. As a result, the operating pressure P rises in the portion T9, following activation of the pressure generating unit 120, to a maximum operating pressure P2max associated with the operating mode. At the time T9, the pressure generating unit 120 is deactivated in an analogous manner to the time T2 and the maximum operating pressure P2max is preferably maintained in the portion 920. At the time T10, the fluid outlet is opened and the operating pressure P drops in the portion 921 to the minimum operating pressure P2min associated with the operating mode. When the minimum operating pressure P2min is reached, or at the time T11, the pressure generating unit 120 is reactivated and builds up the associated operating pressure P2 in the portion 922, this being achieved, as illustrated, from the time T12. In the portion 923, operation, or fluid delivery, takes place until, at the time T13, the fluid delivery is deactivated, with the result that the operating pressure P rises in the portion 924 to the maximum operating pressure P2max and, as illustrated, at the time T14, the control device 240 deactivates the pressure generating unit 120.

Figure 10:
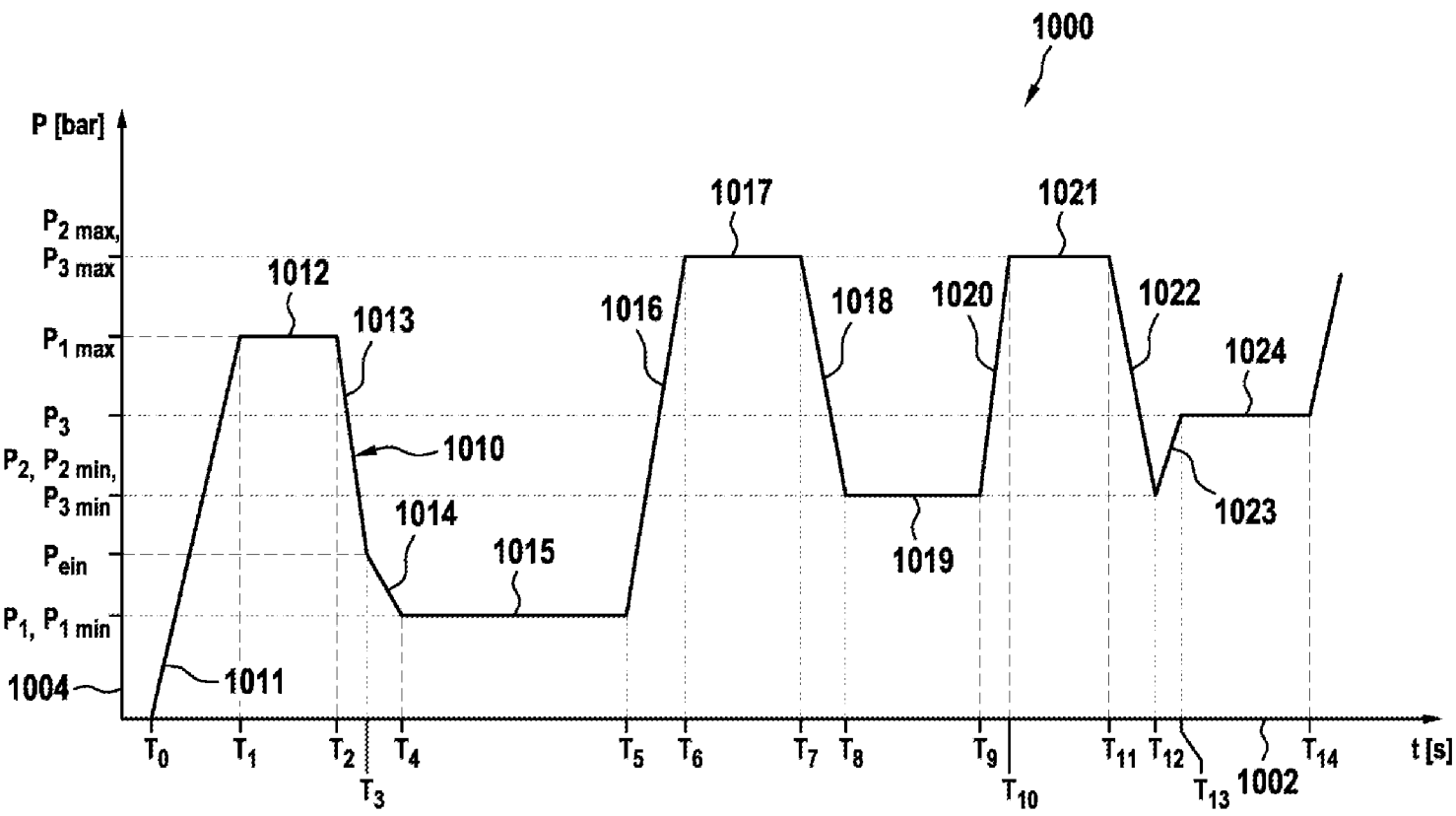
FIG. 10 shows an example of an operating pressure profile for identifying a nozzle change.

FIG. 10 shows a diagram 1000 with an example of an operating pressure profile 1010 of the pressure cleaning device 100 in FIG. 1 and FIG. 3 to FIG. 5. In this case, the operating pressure profile 1010 illustrates identification of a nozzle change. In this case, by way of example, a time t in seconds is plotted on an X-axis 1002 and an operating pressure P is plotted in bar on a Y-axis 1004.

Preferably, a portion 1011, formed between times T0 and T1, of the operating pressure profile 1010 indicates an initial pressure buildup, during which preferably the operating pressure is built up from 0 to, as illustrated, a maximum operating pressure P1max. When the maximum operating pressure P1max is reached, the pressure generating unit 120 is switched off. In the portion 1012, the maximum operating pressure P1max is maintained and in this case, for example, the free flow jet nozzle 166 in FIG. 2 is set. In the portion 1013, when the fluid outlet is opened at the time T2, the operating pressure P then drops to a cut-in pressure Pein. When the cut-in pressure Pein is reached at the time T3, at least the pressure generating unit 120 is activated.

However, on account of the comparatively high volumetric flow rate $\dot{V}$ of the free flow jet nozzle 166, the operating pressure P drops further in the portion 1014, or between the times T3 and T4, to a minimum operating pressure P1min, which forms the operating pressure P1. In this case, the operating pressure P1 lies below the cut-in pressure Pein.

In the portion 1015, operation of the free flow jet nozzle 166 takes place. At the time T5, the nozzle 166 is closed and the operating pressure P rises to an example maximum operating pressure P2max, at which the pressure generating unit 120 is deactivated.

In the portion 1017, or between the times T6 and T7, a nozzle change to the spray jet nozzle 164 in FIG. 2 takes place. When the spray jet nozzle 164 is opened at the time T7, the operating pressure drops in the portion 1018 to an associated minimum operating pressure P2min, with the result that the pressure generating unit 120 is activated. For example, the minimum operating pressure P2min forms in this case the operating pressure P2 on account of the volumetric flow rate $\dot{V}$ of the spray jet nozzle 164.

Following operation of the spray jet nozzle 164 in a portion 1019, said nozzle is closed at the time T9, wherein the operating pressure P rises to an associated maximum operating pressure P3max, at which, in turn, the pressure generating unit 120 is deactivated. In the portion 1021, or between the times T10 and T11, a nozzle change to the cone jet nozzle 162 in FIG. 2 or the fan jet nozzle 168 in FIG. 2 takes place.

When the set nozzle 162, 168, or the fluid outlet, is opened at the time T11, the operating pressure P drops in the portion 1022 to an associated minimum operating pressure P3min, with the result that the pressure generating unit 120 is activated. As a result, the operating pressure P rises in the portion 1023 to an associated operating pressure P3, wherein, in the portion 1024, operation of the set nozzle 162, 168 takes place. At the time T14, the fluid outlet is closed and the operating pressure P rises to the associated maximum operating pressure P3max and the pressure generating unit 120 is deactivated again.

Figure 11:
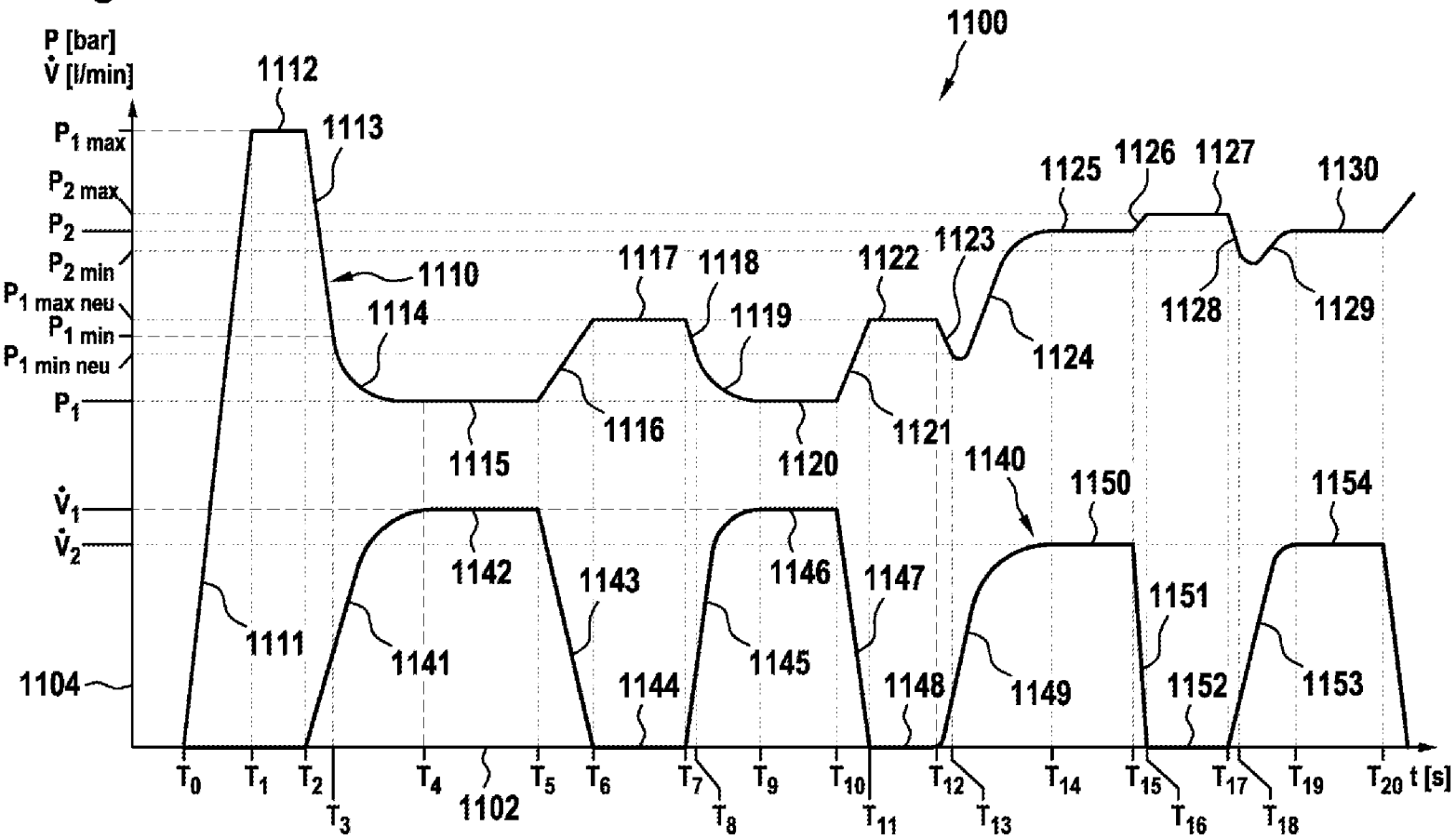
FIG. 11 shows an example of an operating pressure profile for identifying a nozzle change with adaptation of a maximum and minimum operating pressure and with a volumetric flow rate profile.

FIG. 11 shows a diagram 1100 with an example of an operating pressure profile 1110 and an example of a volumetric flow rate profile 1140 of the pressure cleaning device 100 in FIG. 1 and FIG. 3 to FIG. 5, wherein the volumetric flow rate $\dot{V}$ is the same as a flow rate curve. In this case, the operating pressure profile 1110 indicates identification of a nozzle change and adaptation of a maximum and minimum operating pressure. In this case, by way of example, a time t in seconds is plotted on an X-axis 1102 and an operating pressure P in bar and a volumetric flow rate $\dot{V}$ in l/min are plotted on a Y-axis 1104.

Preferably, a portion 1111, formed between times T0 and T1, of the operating pressure profile 1110 indicates an initial pressure buildup, during which preferably the operating pressure is built up from 0 to, as illustrated, a maximum operating pressure P1max. When the maximum operating pressure P1max is reached, the pressure generating unit 120 is switched off.

In the portion 1112, the maximum operating pressure P1max is maintained and in this case, for example, the free flow jet nozzle 166 in FIG. 2 is set. In the portion 1113, when the fluid outlet is opened at the time T2, the operating pressure P then drops to a minimum operating pressure P1min, or a cut-in pressure Pein. When the cut-in pressure Pein is reached at the time T3, at least the pressure generating unit 120 is activated.

However, on account of the comparatively high volumetric flow rate $\dot{V}$ of the free flow jet nozzle 166, the operating pressure P drops further in the portion 1114, or between the times T3 and T4, to an operating pressure P1. In this case, the operating pressure P1 is below the cut-in pressure Pein. From a gradient associated with the portion 1114, the control device 240 identifies which of the nozzles 162, 164, 166, 168 in FIG. 2 is being used, and thus adapts the maximum and minimum operating pressure Pmax, Pmin preferably automatically.

In the portion 1115, operation of the free flow jet nozzle 166 takes place. At the time T5, the fluid outlet is closed and the operating pressure P rises to a new, or adapted, maximum operating pressure P1maxneu, at which the pressure generating unit 120 is deactivated. In the portion 1117, or between the times T6 and T7, operation with the free flow jet nozzle 166 takes place. When the free flow jet nozzle 166, or the fluid outlet, is opened at the time T7, the operating pressure drops in the portion 1118 to a new, or adapted, minimum operating pressure P1minneu, with the result that the pressure generating unit 120 is activated. In this case, the minimum operating pressure P1minneu is configured as a cut-in pressure Pein. Analogously to what is described above, the operating pressure P drops further, on account of the comparatively high volumetric flow rate $\dot{V}$ of the free flow jet nozzle 166, in the portion 1119, or between the times T8 and T9, to the operating pressure P1. In the portion 1120, operation of the free flow jet nozzle 166 takes place. At the time T10, the fluid outlet is closed and the operating pressure P rises to the maximum operating pressure P1maxneu, at which the pressure generating unit 120 is deactivated.

In the portion 1122, a nozzle change then takes place. When the fluid outlet is opened, or in the portion 1123, the operating pressure P drops to the minimum operating pressure P1minneu and the pressure generating unit 120 is activated when the minimum operating pressure P1minneu is reached. In the following portion 1124, the operating pressure P rises to a new operating pressure P2, wherein, as described above, the control device 240 identifies, the used nozzle, for example by correlation, from the gradient of the portion 1124, and thus determines an associated maximum and/or minimum operating pressure P2max, P2min.

In the portion 1125, operation of the new nozzle, as illustrated and by way of example the spray jet nozzle 164 in FIG. 2, or the new fluid jet type takes place. The fluid outlet is closed at the time T15 and the operating pressure P rises to a maximum operating pressure P2max associated with the nozzle 164, at which the pressure generating unit 120 is deactivated. In the portion 1127, operation of the spray jet nozzle 164 does not take place. At the time T17, the fluid outlet is opened and the operating pressure P drops in the portion 1128 to a minimum operating pressure P2min associated with the nozzle 164. When the minimum operating pressure P2min is reached, or at the time T18, the pressure generating unit 120 is reactivated and the operating pressure P rises in the portion 1129 to the operating pressure P2 associated with the nozzle 164. In this case, operation takes place in the portion 1130, being deactivated at the time T20, wherein the operating pressure P rises again.

Furthermore, FIG. 11 illustrates the volumetric flow rate profile 1140, associated with the operating pressure profile 1110, of the pressure cleaning device 100 in FIG. 1 and FIG. 3 to FIG. 5. In this case, when the nozzle 166 is opened, or when the fluid outlet is opened, at the time T2 until the time T4, at which the operating pressure P1 is reached, a volumetric flow rate $\dot{V}$ is built up in a portion 1141. During operation, or in a portion 1142, the volumetric flow rate $\dot{V}$ exhibits its maximum volumetric flow rate $\dot{V}$1 associated with the nozzle 166. When the fluid outlet is closed, or between the times T5 and T6, or in a portion 1143, the volumetric flow rate $\dot{V}$ drops back to 0 again, where it remains until the time T7, or in the portion 1144. Subsequently, when the fluid outlet is opened, in the portion 1145, the volumetric flow rate $\dot{V}$ rises to its maximum value $\dot{V}$1 again and remains there during operation, or in the portion 1146. When the fluid outlet is closed, or in the portion 1147, the volumetric flow rate $\dot{V}$ drops back to 0.

In the following portion 1148, as described above, a nozzle change to the spray jet nozzle 164 in FIG. 2 takes place. When the fluid outlet is opened, or in the portion 1149 or 1153, the volumetric flow rate $\dot{V}$ rises to a maximum volumetric flow rate $\dot{V}$2 associated with the nozzle 164, and when the fluid outlet is closed, or in the portion 1151, it drops back to 0, where it remains with the pressure generating unit 120 deactivated, or in the portion 1152.

Furthermore, the present disclosure describes a method for identifying the hose attachment, in particular a fluid jet type of a hose attachment of the pressure cleaning device 100 in FIG. 1 and FIG. 3 to FIG. 5, having the pressure generating unit 120 for pressurizing a fluid. The preferably electric pressure sensor 220 in this case determines a respectively current operating pressure P and/or a flow rate sensor determines a respectively current flow rate, or volumetric flow rate $\dot{V}$. The control device 240 then uses the determined operating pressure P and/or the determined flow rate or determined volumetric flow rate $\dot{V}$ to establish the operating pressure curve 1110 or flow rate curve or volumetric flow rate curve 1140. Then, preferably to identify the hose attachment 150 or the fluid jet type, the control device 240 correlates the established operating pressure curve 1110 and/or flow rate curve or volumetric flow rate curve 1140 with stored operating pressure curves or flow rate curves, in particular in order to set an operating mode of the pressure generating unit.

It should be noted that the control device 240 in the shown figures controls the pressure generating unit 120 depending on the operating pressure P, although this should not be considered as limiting the disclosure. Thus, the control device 240 can also control the pressure generating unit depending on the volumetric flow rate $\dot{V}$ or a flow rate equivalent to the volumetric flow rate $\dot{V}$.

It should also be noted that the shown operating pressure curve and volumetric flow rate curve, and the operating pressures and volumetric flow rates associated with the operating modes are able to be determined by experimentation and thus at least approximately reflect typical values. In this case, the respective profiles and portions are formed in a linear, parabolic and/or exponential manner merely by way of example, and this should not be considered as limiting the disclosure. Furthermore, the values described in the disclosure are merely by way of example and should not be considered as limiting the disclosure.

The invention claimed is:

1. A pressure cleaning device comprising:

a pressure generating unit configured to pressurize a fluid and deliver the pressurized fluid via a hose attachment; and an operating unit configured to set a maximum set operating pressure of the pressure generating unit, wherein the operating unit is configured to automatically determine at least one of the maximum set operating pressure and a minimum set operating pressure of the pressure generating unit based on at least one of an operating pressure curve and a flow rate curve.

2. The pressure cleaning device as claimed in claim 1, wherein the operating unit is configured to set at least one variable drive parameter of the pressure generating unit.

3. The pressure cleaning device as claimed in claim 1, wherein the operating unit is configured to set the minimum set operating pressure, the pressure generating unit being activated at the minimum set operating pressure.

4. The pressure cleaning device as claimed in claim 1 further comprising:

a control device configured to control the pressure generating unit based on at least one of the maximum set operating pressure, the minimum set operating pressure, and at least one variable drive parameter of the pressure generating unit.

5. The pressure cleaning device as claimed in claim 4, wherein the control device is configured to at least one of (i) control the pressure generating unit to prevent a current operating pressure from exceeding the maximum set operating pressure by deactivating the pressure generating unit, (ii) activate at least the pressure generating unit in response to the current operating pressure dropping below the minimum set operating pressure, and (iii) activate at least the pressure generating unit in response to the current operating pressure dropping below a cut-in pressure.

6. The pressure cleaning device as claimed in claim 2, wherein:

the pressure generating unit has an electric motor; and the at least one variable drive parameter is a speed of the electric motor.

7. The pressure cleaning device as claimed in claim 6, further comprising:

a control device assigned to the pressure generating unit and configured to control the speed of the electric motor.

8. The pressure cleaning device as claimed in claim 1, wherein:

the pressure generating unit has a pump; and the pressure cleaning device further comprises a measuring unit arranged at a pump outlet of the pump and configured to determine a current operating pressure of the pressure generating unit.

9. The pressure cleaning device as claimed in claim 8, wherein the measuring unit is at least one of a pressure sensor and a flow rate sensor.

10. The pressure cleaning device as claimed in claim 1 further comprising:

a rechargeable battery pack configured to supply power to the pressure generating unit.

11. The pressure cleaning device as claimed in claim 1, wherein:

the pressure generating unit is configured to generate a maximum pressure generating unit operating pressure of less than 25 bar; and the pressure cleaning device is configured to operate without a nozzle distancing element.

12. The pressure cleaning device as claimed in claim 3, wherein the operating unit is configured to at least one of (i) set the maximum set operating pressure higher than a current operating pressure by one of a predefined percentage and a predefined absolute pressure and (ii) set the minimum set operating pressure lower than the current operating pressure by one of a predefined percentage and a predefined absolute pressure.

13. The pressure cleaning device as claimed in claim 1, wherein the hose attachment is a hand gun having at least two different nozzles configured to selectively deliver at least two different fluid jet types.

14. The pressure cleaning device as claimed in claim 13 further comprising:

a control device configured to identify one of a currently used hose attachment and a currently used fluid jet type based on at least one of (i) a current operating pressure, (ii) the operating pressure curve, (iii) a current flow rate, and (iv) the flow rate curve.

15. The pressure cleaning device as claimed in claim 1, wherein the hose attachment is a hand gun or a cleaning nozzle.

16. The pressure cleaning device as claimed in claim 9, wherein the pressure sensor is an electric pressure sensor.

17. The pressure cleaning device as claimed in claim 4 wherein the control device is further configured to:

at least one of switch on and switch off the pressure generating unit based on at least one of the maximum set operating pressure, the minimum set operating pressure, and the at least one variable drive parameter.

18. The pressure cleaning device as claimed in claim 11, wherein the pressure generating unit is configured to generate the maximum pressure generating unit operating pressure of less than 20 bar.

19. The pressure cleaning device as claimed in claim 11, wherein the pressure generating unit is configured to generate the maximum pressure generating unit operating pressure of less than 15 bar.

20. A pressure cleaning device comprising:

a pressure generating unit configured to pressurize a fluid and deliver the pressurized fluid via a hose attachment, wherein the hose attachment includes at least two different nozzles configured to selectively deliver at least two different fluid jet types; and a control device configured to identify one of a currently used hose attachment and a currently used fluid jet type based on at least one of (i) a current operating pressure, (ii) an operating pressure curve, (iii) a current flow rate, and (iv) a flow rate curve.

21. The pressure cleaning device of claim 20, wherein the control device is further configured to adjust an operating pressure of the pressure cleaning device based upon the identified one of the currently used hose attachment and the currently used fluid jet type.

* * * * *